US011802675B2

(12) United States Patent
Kim

(10) Patent No.: US 11,802,675 B2
(45) Date of Patent: Oct. 31, 2023

(54) LAMP FOR VEHICLE AND VEHICLE INCLUDING THE SAME

(71) Applicant: HYUNDAI MOBIS CO., LTD., Seoul (KR)

(72) Inventor: Seok Huyn Kim, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/811,536

(22) Filed: Jul. 8, 2022

(65) Prior Publication Data

US 2023/0058495 A1 Feb. 23, 2023

(30) Foreign Application Priority Data

Aug. 17, 2021 (KR) ..... 10-2021-0108133

(51) Int. Cl.

| | |
|---|---|
| ***F21S 41/265*** | (2018.01) |
| ***F21S 41/32*** | (2018.01) |
| ***F21S 41/147*** | (2018.01) |
| ***F21S 43/245*** | (2018.01) |
| ***F21V 5/00*** | (2018.01) |

(Continued)

(52) U.S. Cl.

CPC ..... *F21S 41/265* (2018.01); *F21S 41/147* (2018.01); *F21S 41/32* (2018.01); *F21S 41/143* (2018.01); *F21S 41/145* (2018.01); *F21S 41/148* (2018.01); *F21S 41/20* (2018.01); *F21S 41/26* (2018.01); *F21S 41/27* (2018.01); *F21S 41/285* (2018.01); *F21S 43/20* (2018.01); *F21S 43/235* (2018.01); *F21S 43/239* (2018.01); *F21S 43/241* (2018.01);

(Continued)

(58) Field of Classification Search

CPC ..... F21S 41/24; F21S 41/265; F21S 41/285; F21S 41/143; F21S 41/145; F21S 41/147; F21S 41/148; F21S 43/245; F21S 43/243; F21S 43/26; F21S 43/241; F21S 43/239; F21S 43/235; F21S 41/20; F21S 41/27; F21S 41/26; F21V 5/008

See application file for complete search history.

(56) References Cited

U.S. PATENT DOCUMENTS

| | | | | |
|---|---|---|---|---|
| 10,655,811 | B2 * | 5/2020 | Buzzurro | F21S 43/239 |
| 2017/0059113 | A1 * | 3/2017 | Gloss | F21S 43/145 |

(Continued)

FOREIGN PATENT DOCUMENTS

| | | | | |
|---|---|---|---|---|
| DE | 102018201277 | A1 * | 8/2019 | |
| FR | 2695362 | A1 * | 3/1994 | F21S 43/237 |
| FR | 3075312 | A1 * | 6/2019 | B60Q 1/2607 |

OTHER PUBLICATIONS

Machine translation of DE 102018201277 A1 retrieved from the FIT database of PE2E search. (Year: 2023).*

(Continued)

*Primary Examiner* — Colin J Cattanach

(74) *Attorney, Agent, or Firm* — DLA PIPER LLP (US)

(57) ABSTRACT

A lamp for a vehicle includes a light source that irradiates light, and an inner lens, one surface of which faces the light source, the inner lens may be disposed in a horizontal direction such that a main plane thereof faces an upper side and a lower side, the light source may face a lower side of the inner lens, among the light output from the light source, the light output through one side surface of the inner lens after being input to the inner lens through the lower side of the inner lens may form a first lighting image.

19 Claims, 5 Drawing Sheets

(51) Int. Cl.

| | |
|---|---|
| ***F21S 41/143*** | (2018.01) |
| ***F21S 43/239*** | (2018.01) |
| ***F21S 41/145*** | (2018.01) |
| ***F21S 41/27*** | (2018.01) |
| ***F21S 43/20*** | (2018.01) |
| ***F21S 41/20*** | (2018.01) |
| ***F21S 41/26*** | (2018.01) |
| ***F21S 43/241*** | (2018.01) |
| ***F21S 41/148*** | (2018.01) |
| ***F21S 43/243*** | (2018.01) |
| ***F21S 43/235*** | (2018.01) |

(52) U.S. Cl.
CPC ..... *F21S 43/243* (2018.01); *F21S 43/245* (2018.01); *F21S 43/26* (2018.01); *F21V 5/008* (2013.01)

(56) References Cited

U.S. PATENT DOCUMENTS

| | | | | |
|---|---|---|---|---|
| 2020/0300434 | A1* | 9/2020 | Gloss | F21S 43/14 |
| 2021/0148538 | A1* | 5/2021 | Allen | F21S 43/15 |
| 2021/0382321 | A1* | 12/2021 | Khayat | B60R 13/04 |
| 2022/0003382 | A1* | 1/2022 | Kim | F21S 43/37 |

OTHER PUBLICATIONS

Machine translation of FR 3075312 A1 retrieved from the FIT database of PE2E search. (Year: 2023).*

Machine translation of FR 2695362 A1 retrieved from the FIT database of PE2E search. (Year: 2023).*

* cited by examiner

LAMP FOR VEHICLE AND VEHICLE INCLUDING THE SAME

CROSS-REFERENCE TO RELATED APPLICATION

This application claims the benefit of priority to Korean Patent Application No. 10-2021-0108133, filed in the Korean Intellectual Property Office on Aug. 17, 2021, the entire contents of which are incorporated herein by reference.

TECHNICAL FIELD

The present disclosure relates to a lamp for a vehicle, and a vehicle including the same, and more particularly, to a lamp for a vehicle that may implement a three-dimensional lighting image, and a vehicle including the same.

BACKGROUND

As requirements of consumers for aesthetic aspects of lamps for a vehicle that provide visibility to drivers and provide various information on travel state of a vehicle to an outside have increased in addition to basic functions of the lamps, studies on the lamps for a vehicle having various forms of lighting images have been actively made. As an example, a special lens that may implement a lighting image of a 3D shape may be applied to a lamp for a vehicle.

However, according to a conventional technology, even though a special lens is applied to a lamp for a vehicle, a lighting image of a 3D shape is not sufficiently implemented and features of the special lens cannot be properly utilized, and thus a light emission efficiency of the lamp for a vehicle including the special lens may be degraded.

FIG. 1 illustrates a lamp for a vehicle according to a conventional technology. In a discussion of a structure of the lamp for a vehicle according to the conventional technology, light is irradiated from a light source 1 provided in a rear area of the lamp, and forms a lighting image after passing through a first lens 2 and a second lens 3 provided in a front area of the lamp. However, when a lighting image of a 3D shape is implemented, a three-dimensional feeling is rather degraded in the image by a rear irradiation scheme, and when the second lens 3 is arranged vertically, lateral light output from a side surface "S" of the second lens 3 cannot be used.

SUMMARY

The present disclosure has been made to solve the above-mentioned problems occurring in the prior art while advantages achieved by the prior art are maintained intact.

An aspect of the present disclosure provides a lamp for a vehicle that may implement a lighting image of a 3D shape more effectively as compared with a conventional technology.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a lamp for a vehicle includes a light source that irradiate slight, and an inner lens, one surface of which faces the light source, the inner lens may be disposed in a horizontal direction such that a main plane thereof faces an upper side and a lower side, the light source may face a lower side of the inner lens, among the light output from the light source, the light output through one side surface of the inner lens after being input to the inner lens through the lower side of the inner lens may form a first lighting image, and, among the light output from the light source, the light output through the main plane of the inner lens, which faces the upper side, after being input to the inner lens through the lower side of the inner lens may form a second lighting image having a shape that is different from the first lighting image.

The first lighting image may have a 2D image, and the second lighting image may have a 3D image.

The inner lens may include a first inner lens provided in a lower area of the inner lens, and a second inner lens attached to the first inner lens on an upper side of the first inner lens, and the first lighting image may be formed by, among the light output from the light source, the light output through one side surface of the second inner lens after being input to the second inner lens through a lower side of the second inner lens.

The second lighting image may be formed by, among the light output from the light source, the light output through an upper surface of the second inner lens after being input to the second inner lens through the lower side of the second inner lens.

The second inner lens may be a lenticular lens.

The first inner lens may include a body part defining a body of the first inner lens, a downward protrusion provided at a front end of the body part and protruding downwards, and a forward protrusion provided on a front surface of the downward protrusion and protruding to a front side.

The body part may include a condensing surface formed to be convex from a lower side of the body part to an outer side, and to which the light output from the light source is input, and a diffusion surface formed at an upper portion of the body part, and that outputs the light input to the condensing surface to the second inner lens.

The condensing surface may include a Fresnel lens shape that condenses the light output from the light source.

The diffusion surface may include a fine optic that diffuses the light output from the light source.

The diffusion surface may include a fine optic that diffuses the light output from the light source after the light converges.

The forward protrusion may include a first forward protrusion extending from an end of the downward protrusion and protruding to the front side, and a second forward protrusion protruding from the downward protrusion to the front side, and provided at an upper portion of the first forward protrusion.

The lamp may include a board, on which the light source is provided, and a support member provided under the board, and a partial area of which is attached to the second forward protrusion.

The support member may be attached to a front surface and an upper surface of the second forward protrusion.

The first forward protrusion may contact the board on an upper side of the board.

An upper surface of the inner lens and a lower surface of the second inner lens may be bonded to each other.

The lamp may further include a reflector provided at an upper portion of the second inner lens, and a rear end of the second inner lens may be inserted into a space defined between a rear end or the reflector and a rear end of the first inner lens.

The reflector may be formed in a planar shape, is inclined toward a front side, and reflects the light output through an upper surface of the second inner lens.

The reflector may be formed in a curved shape, is configured such that a convex surface thereof is inclined toward a front side, and reflects the light output through an upper surface of the second inner lens to the front side.

The first inner lens may include an upward protrusion provided at the rear end of the first inner lens, and protruding upwards toward the reflector, and the second inner lens may be attached to a front surface of the upward protrusion.

According to another aspect of the present disclosure, a vehicle includes a lamp, the lamp includes a light source that irradiates light, and an inner lens, one surface of which faces the light source, the inner lens is disposed in a horizontal direction such that a main plane thereof faces an upper side and a lower side, the light source is that faces a lower side of the inner lens, among the light output from the light source, the light output through one side surface of the inner lens after being input to the inner lens through the lower side of the inner lens forms a first lighting image, and among the light output from the light source, the light output through the main plane of the inner lens, which faces an upper side, after being input to the inner lens through the lower side of the inner lens forms a second lighting image having a shape that is different from the first lighting image.

The lamp may be provided on a rear side of the vehicle.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
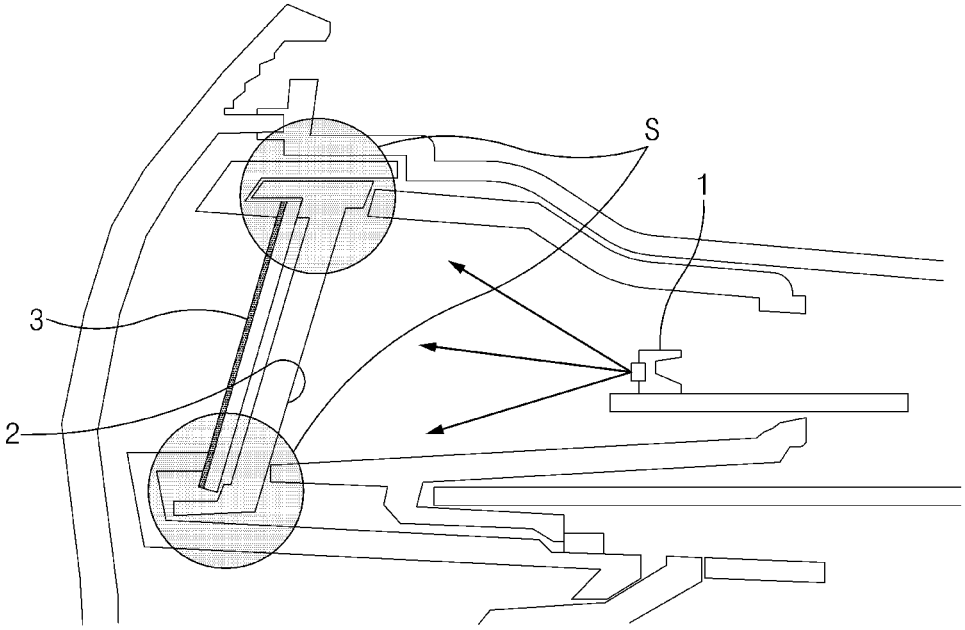
FIG. 1 is a cross-sectional view illustrating a schematic structure of a conventional lamp for a vehicle.

Hereinafter, a lamp for a vehicle and a vehicle according to the present disclosure will be described with reference to the drawings. Hereinafter, preferred embodiments of the present disclosure will be described in detail with reference to the accompanying drawings so that an ordinary person in the art to which the present disclosure pertains may easily carry out the present disclosure. However, the present disclosure may be implemented in various different forms, and is neither restricted nor limited by the following embodiments.

In order to clearly describe the present disclosure, a detailed description of a part that is not related to the description or related known technologies that may make the essence of the present disclosure unclear will be omitted, and in adding reference numerals to elements of the drawings in the specification, the same or similar reference numerals will be given to the same or similar elements throughout the specification.

It will be noted that the terms and wordings used in the specification and the claims should not be construed as general and lexical meanings, but should be construed as the meanings and concepts that agree with the technical spirits of the present disclosure, based on the principle stating that the concepts of the terms may be properly defined by the inventor(s) to describe the present disclosure in the best manner.

Lamp for Vehicle

Figure 2:
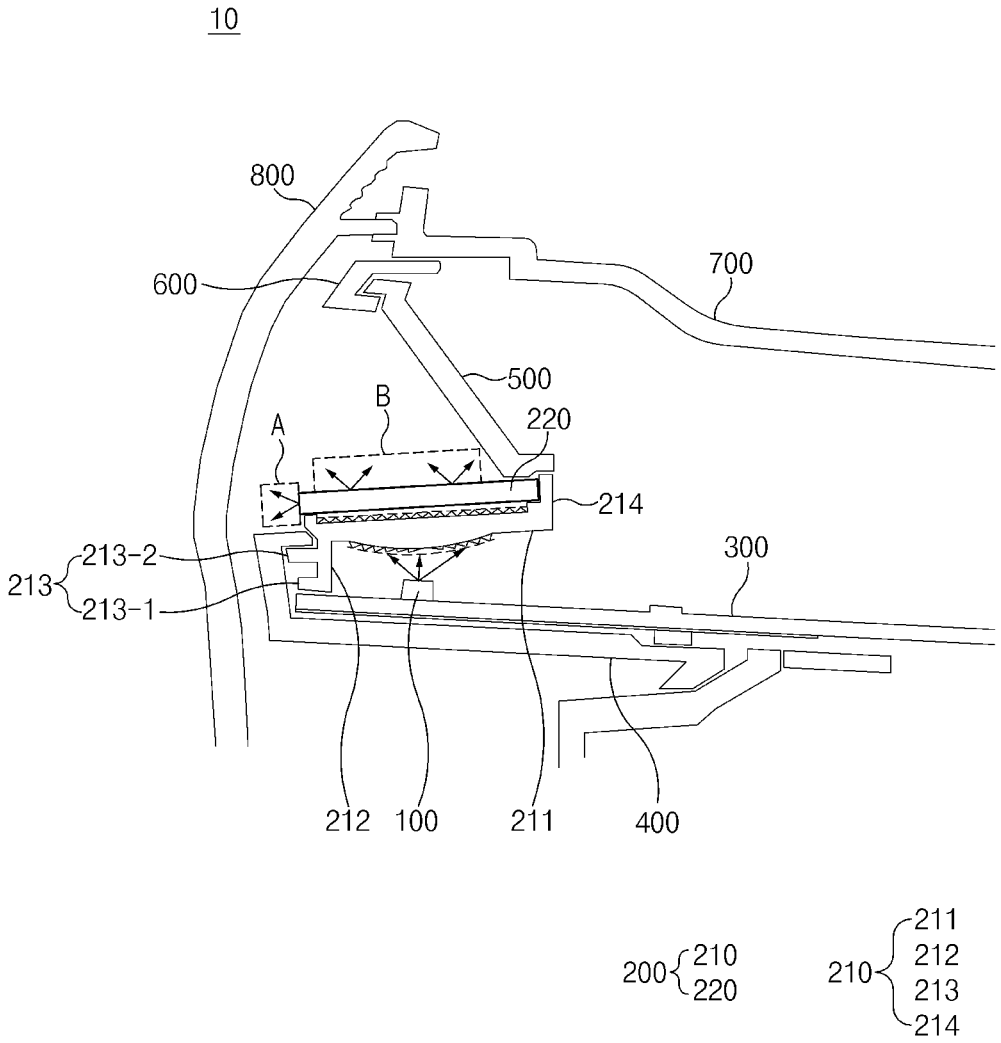
FIG. 2 is a cross-sectional view illustrating a schematic structure of a lamp for a vehicle according to an embodiment of the present disclosure.

As illustrated in FIG. 2, a lamp 10 for a vehicle (hereinafter, referred to as 'a lamp') according to the present disclosure includes a light source 100 that outputs light, and an inner lens 200, one surface of which faces the light source 100.

First, a kind of the light source 100 is not limited, but the light source 100 may preferably an LED. Furthermore, the light source 100 may be located on a lower side of the inner lens 200 and may be configured to face a lower side or the inner lens 200.

Referring to FIG. 2 continuously, the inner lens 200 may be disposed in a horizontal direction such that a main plane faces an upper side and a lower side. A plurality of surfaces may be formed at a circumference of the inner lens 200, and the main plane of the inner lens 200 may refer to, among the plurality of surfaces of the above-described inner lens 200, a surface that has a relatively large area. Accordingly, an aspect that the main plane of the inner lens 200 is disposed in the horizontal direction to face the upper side and the lower side may mean that, among the plurality of surfaces, a surface having a relatively large area is disposed in a state, in which the inner lens 200 is laid in the horizontal direction, while facing the upper side and the lower side. In this case, because an upward/downward size of the lamp 10 may be reduced, the lamp 10 may be implemented to be slim as compared with a conventional one.

According to the lamp 10 according to the present disclosure, the light output from the light source 100 may be input to the inner lens 200, and may output to an outside through the plurality of surfaces formed in the inner lens 200. Here, according to the present disclosure, a lighting image of another shape may be formed according to which of the plurality of surfaces of the inner lens 200 light is output to an outside. That is, according to the lamp 10 according to the present disclosure, a lighting image of the lamp 10 may be changed according to a location, from which the lamp 10 is viewed. The lighting image may refer to an image of the lamp 10, which is recognized by eyes of a person who views the lamp 10 from an outside of the lamp 10 when the light source 100 is lighted.

The lamp 10 according to the present disclosure may form a first lighting image and a second lighting image as the light output from the light source passes through the inner lens 200. The first lighting image may be formed by, among the light output from the light source 100, light "A" output through one side surface of the inner lens 200 after being input to the inner lens 200 through a lower side of the inner lens 200. The second lighting image may be formed by, among the light output from the light source 100, light "B" output through a main plane of the inner lens 200, which faces an upper side, after being input to the inner lens 200 through the lower side of the inner lens 200. Accordingly, the lamp 10 according to the present disclosure may enhance optical efficiency by utilizing lateral light of the lens and may implement various lighting images in the one lamp 10 as compared with a case, in which the inner lens 200 is vertically disposed. In this way, the present disclosure may implement various lighting images in the one lamp 10 at the same time, and may achieve differentiation of designs of the lamp 10 and the vehicle through a complex lighting image.

Figure 3:
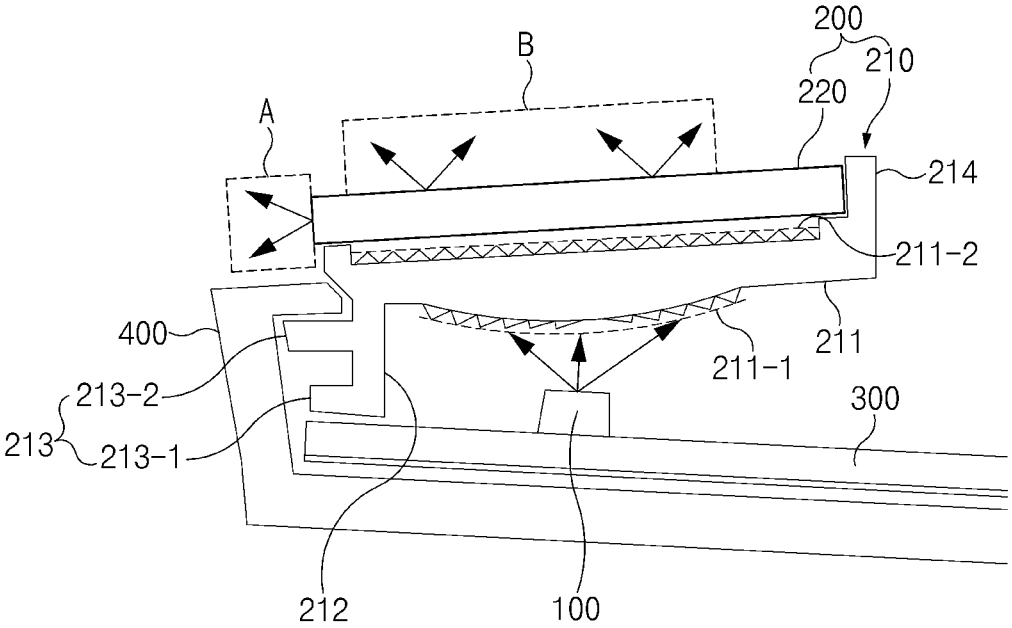
FIG. 3 is an enlarged cross-sectional view illustrating a state, in which light output from a light source of a lamp for a vehicle is output through an inner lens, according to the present disclosure.
Figure 4:
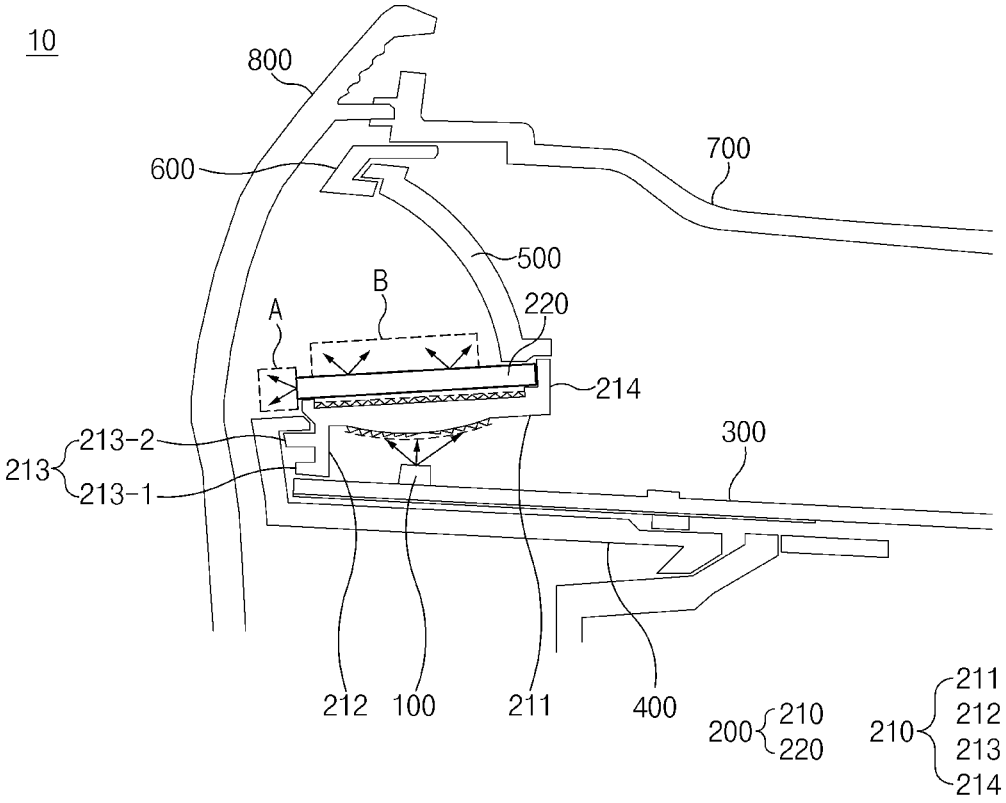
FIG. 4 is a cross-sectional view illustrating a schematic structure of a lamp for a vehicle according to another embodiment of the present disclosure.

Referring to FIGS. 3 and 4, a configuration of the lamp 10 according to the present disclosure will be described in more detail. FIG. 3 is an enlarged cross-sectional view illustrating a state, in which light output from the light source of the lamp for a vehicle is output through the inner lens, according to the present disclosure. FIG. 4 is a cross-sectional view schematically illustrating a lamp for a vehicle according to another embodiment of the present disclosure.

First, as illustrated in FIG. 3, the inner lens 200 may include a first inner lens 210 and a second inner lens 220. The first inner lens 210 may be provided in a lower area of the inner lens 200, and the second inner lens 220 may be attached to the first inner lens 210 at an upper portion of the first inner lens 210. Here, an aspect that the second inner lens 220 is attached to the first inner lens 210 at an upper portion thereof may mean that the second inner lens 220 is stacked on the first inner lens 210, and then, an upper surface of the first inner lens 210 and a lower surface of the second inner lens 220 may be bonded to each other.

The first lighting image may be formed by, among the light output from the light source 100, the light "A" output through the one side surface of the second inner lens 220 after being input to the second inner lens 220 through a lower side of the second inner lens 220. Here, the one side surface of the second inner lens 220 may refer to, a plurality of surfaces formed in the second inner lens 220, a surface that faces a front side of the lamp 10.

Meanwhile, the second lighting image may be formed by, among the light output from the light source 100, the light "B" output through the upper surface of the second inner lens 220 after being input to the second inner lens 220 through the lower side of the second inner lens 220. Here, it may be understood that the upper surface of the second inner lens 220 is the same as the main plane of the second inner lens 220, which faces the upper side.

The second inner lens 220 of the lamp 10 according to the present disclosure may be a lenticular lens. The lenticular lens is a special form of lens that is manufactured such that an image is changed according to an angle, at which a user views it from an outside. Accordingly, when the second inner lens 220 of the present disclosure is the lenticular lens, different lighting images may be implemented according to viewing angles. In particular, when the second inner lens 220 is the lenticular lens and is disposed to be laid in a horizontal direction in the lamp 10 according to the present disclosure, a lighting image of a 2D shape having a uniform image in respective areas may be implemented by the light "A" output through the front side surface of the lenticular lens, and a lighting image of a three-dimensional 3D shape may be implemented due to a binocular disparity by the light "B" output through the upper surface of the lenticular lens.

Continuously, referring to FIG. 3, in a detailed description of the configuration of the first inner lens 210, the first inner lens 210 may include a body part 211, a downward protrusion 212, a forward protrusion 213, and an upward protrusion 214. The body part 211 may define a body of the first inner lens 210, and may function to support the second inner lens 220 on a lower side of the second inner lens 220. The downward protrusion 212 may be provided at a front end of the body part 211 and protrude downwards, and the first inner lens 210 may be supported by a board 300 and a support member 400, which will be described below. The forward protrusion 213 may be provided on a front surface of the downward protrusion 212 to protrude to a front side, and may cause the first inner lens 210 to be supported by the board 300 and the support member 400, which will be described below, together with the downward protrusion 212, and in particular, the first inner lens 210 may be fixed while not being moved in upward/downward directions.

The body part 211 may have a structure that functions to support the second inner lens 220, causes the light output from the light source 100 to be input and be output toward the second inner lens 220, and increases optical efficiency and forms various lighting images. To achieve this, the body part 211 of the first inner lens 210 according to the present disclosure may include a condensing surface 211-1 formed to be convex from a lower side of the body part 211 to an outside and to which the light output from the light source 100 is input, and a diffusion surface 211-2 formed at an upper portion of the body part 211 and to which the light input from the condensing surface 211-1 to the second inner lens 220. Here, the condensing surface 211-1 and the diffusion surface 211-2 may be surfaces that are located on opposite sides or the body part 211 of the first inner lens 210. Furthermore, an aspect that the condensing surface 211-1 is formed to be convex from the lower side of the body part 211 to the outside may mean that the lower surface of the first inner lens 210, which faces the light source 100, protrudes toward the light source 100 while having a specific curvature as a whole.

Referring to FIG. 3, the condensing surface 211-1 may have a Fresnel lens shape that condenses the light output from the light source 100. The Fresnel lens may refer to a lens having an optical structure that is etched to have a continuous concentric groove on one surface thereof, and may be manufactured of plastic such as acryl, PVC, PC, and HDPE. When the condensing surface 211-1 of the body part 211 of the first inner lens according to the present disclosure is formed of a Fresnel lens, an optical efficiency for the volume of the lens may be increased due to excellent condensing power even though the lens is formed to be thin, and manufacturing costs may be reduced.

Meanwhile, the diffusion surface 211-2 may include fine optics such that the light output from the light source 100 is diffused. Here, the fine optics that diffuse light may refer to a plurality of concave structures that are formed on a surface of the diffusion surface 211-2 of the first inner lens 210 and are recessed in a direction, in which the light travels. In this way, the light input to the concave structures of the diffusion surface 211-2 may travel after being output and diffused.

Furthermore, the diffusion surface 211-2 may include fine optics such that the light output from the light source 100 is diffused after converging. Here, the fine optics that diffuse light after converging the light may refer to a plurality of convex structures that are formed on a surface of the diffusion surface 211-2 of the first inner lens 210 and protrude in a direction that faces the light source 100. In this way, the light input to the convex structures of the diffusion surface 211-2 may travel after converging and being diffused after being output. In this way, when the diffusion surface 211-2 includes the fine optics, the input light may be uniformly spread out in all directions, and thus a lighting image of a uniform intensity of light may be implemented.

Next, the forward protrusion 213 may include a first forward protrusion 213-1 and a second forward protrusion 213-2. The first forward protrusion 213-1 may extend from an end of the downward protrusion 212 and protrude to a front side, and the second forward protrusion 213-2 may protrude from the downward protrusion 212 to the front side, and may be provided at an upper portion of the first forward protrusion 213-1 to protrude to the front side. In this way, the forward protrusion 213 may include the first forward protrusion 213-1 and the second forward protrusion 213-2, and may support and fix the first inner lens 210 in an interior of the lamp 10.

The lamp 10 according to the present disclosure may include the board 300, on which the light source 100 is provided. The board 300 may function to deliver an electric signal such that the light source 100 outputs the light and function to support the inner lens 200 as well. Furthermore, the lamp 10 according to the present disclosure may be provided under the board 300, and a partial area thereof may further include the support member 400 that is attached to the second forward protrusion 213-2. Here, the partial may refer to a front area of the support member 400. That is, the support member 400 may be formed under the board 300 to have a flat plate shape to support the board 300, and may be bent in a front area to be attached to the second forward protrusion 213-2. In more detail, the support member 400 may be attached to a front surface and an upper surface of the second forward protrusion 213-2. Accordingly, the first inner lens 210 may be prevented from moving or deviating to the front area and may be prevented from moving in upward/downward directions, and thus a structural stability of the lamp 10 may be secured and a uniform lighting image may be implemented.

In this way, the first forward protrusion 213-1 and the second forward protrusion 213-2 may prevent the first inner lens 210 from deviating to the front area, and also the first forward protrusion 213-1 may be provided to contact the board 300 at an upper portion of the board 300 and support the first inner lens 210 and the second forward protrusion 213-2 may be configured such that a front surface and an upper surface thereof are attached to the support member 400 to prevent the first inner lens 210 from moving upwards and downwards.

Continuously, referring to FIG. 3, the lamp 10 according to the embodiment of the present disclosure may further include a reflector 500 that is provided at an upper portion of the second inner lens 220. Then, a rear end of the second inner lens 220 may be inserted into a space defined between a rear end of the reflector 500 and a rear end of the first inner lens 210. Accordingly, the second inner lens 220 located on an upper side of the first inner lens 210 may be fixed while not deviating. More preferably, the first inner lens 210 of the present disclosure may include the upward protrusion 214 that is provided at a rear end of the first inner lens 210 and protrudes upward toward the reflector 500, and the second inner lens 220 may be provided to be attached to a front surface or the upward protrusion 214.

Meanwhile, in the lamp 10 according to the present disclosure, the reflector 500 may have various shapes. As in FIG. 2, according to the embodiment of the present disclosure, the reflector 500 may have a planar shape, may be provided to be inclined toward a front side, and may reflect the light output through the upper surface of the second inner lens 220 to the front side. Because the same three-dimensional image may be maintained even though an area of the second inner lens 220 is reduced as compared with a conventional technology when the light is reflected to the front side through the reflector 500 provided to be inclined toward the front side, an entire size of the lamp 10 may be reduced, and in particular, when the second inner lens 220 is a high-priced lenticular lens, a size of the lenticular lens may be reduced and costs may be reduced. Furthermore, the light output through the lenticular lens is reflected by the reflector 500, and a three-dimensional feeling of a 3D lighting image may be further reinforced.

Meanwhile, in FIG. 4, according to another embodiment of the present disclosure, the reflector 500 may have a curved shape, may be provided such that the concave surface is inclined toward the front side, and may reflect the light output through the upper surface of the second inner lens 220 to the front side. In this case, the same effect as that of the planar reflector 500 may be expected, and a condensing function may be further added due to the curved shape whereby stronger light may be sent to the front side.

Figure 5:
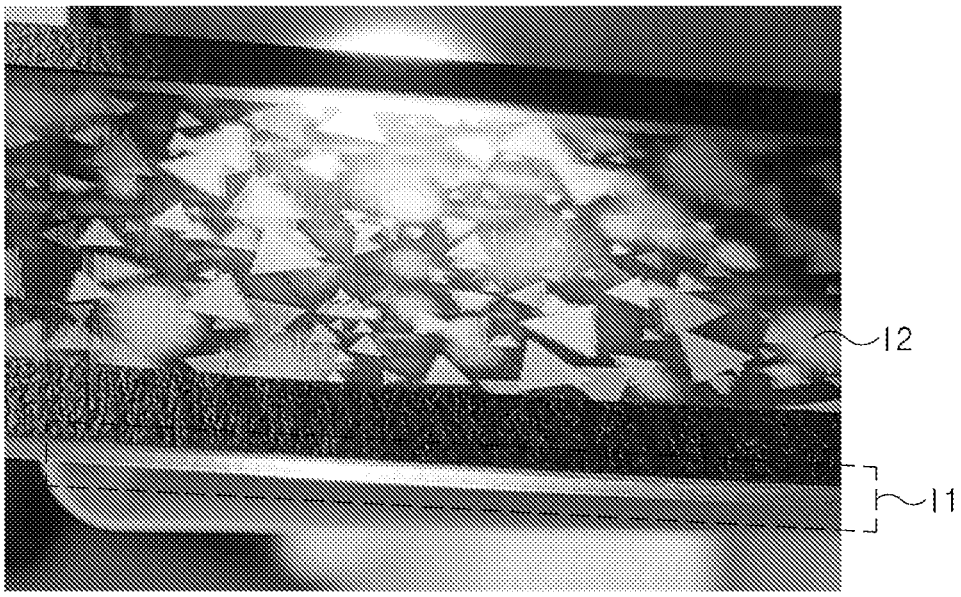
FIG. 5 is a view illustrating an example of a first lighting image formed by light output through a front side surface of a second inner lens and a second lighting image formed by light output through a main plane that faces an upper side of the second inner lens, in a lamp for a vehicle according to the present disclosure.

FIG. 5 is a view illustrating an example of a first lighting image formed by light output through a front side surface of a second inner lens and a second lighting image formed by light output through a main plane that faces an upper side of the second inner lens, in a lamp for a vehicle according to the present disclosure.

As illustrated in FIG. 5, the lamp according to the present disclosure may form a first lighting image I1 and a second lighting image I2. Here, the first lighting image I1 and the second lighting image I2 may have different shapes. In more detail, the first lighting image I1 formed by the lamp according to the present disclosure may have a 2D image, and the second lighting image I2 may have a 3D image. In this way, the present disclosure may implement various lighting images in the one lamp 10 at the same time, and may achieve differentiation of designs of the lamp 10 and the vehicle through a complex lighting image.

In addition, referring to FIG. 2, the lamp 10 according to the present disclosure may further include a bezel part 600 that faces a front end of the reflector 500, may further include a case 700 that accommodates the light source 100, the inner lens 200, the support member 400, and the reflector 500 and a front side of which is opened, and may further include an outer lens 800 coupled to a front side of the case 700.

Vehicle

Referring to FIG. 2, the vehicle according to the present disclosure may include the lamp 10 for a vehicle (hereinafter, referred to as 'a lamp').

Here, the lamp 10 may include the light source 100 that outputs light, and the inner lens 200 that faces the light source 100. Furthermore, the inner lens 200 may be disposed in a horizontal direction such that the main plane faces the upper side and the lower side, and the light source 100 may face the lower side of the inner lens 200.

Meanwhile, referring to FIGS. 2 and 5, among the light output from the light source 100, the light output through the one side surface of the inner lens 200 after being input to the inner lens 200 through the lower side of the inner lens 200 forms the first lighting image I1, and among the light output from the light source 100, the light output through the main plane of the inner lens 200, which faces the upper side, after being input to the inner lens 200 through the lower side of the inner lens 200 may form the second lighting image I2 having a shape that is different from that of the first lighting image I1.

Furthermore, the lamp 10 according to the present disclosure may be a rear lamp that is provided on a rear side of the vehicle. Meanwhile, the contents that have been described above in relation to the lamp according to the present disclosure may be applied to the lamp for a vehicle provided in a vehicle in the same manner.

According to the present disclosure, a lamp for a vehicle that may implement a lighting image of a 3D shape more effectively as compared with a conventional technology may be provided.

Although it is apparent that the present disclosure has been described with reference to the limited embodiments and the drawings, the present disclosure is not limited thereto, and the present disclosure may be variously carried out by an ordinary person in the art within the technical spirit of the present disclosure and the equivalent ranges of the claims.

What is claimed is:

1. A lamp for a vehicle, comprising: a light source configured to irradiate light; and an inner lens having one surface that faces the light source, wherein the inner lens is disposed in a horizontal direction such that a main plane thereof faces an upper side of the lamp and a lower side of the lamp, and wherein the inner lens includes at least: a first inner lens provided in a lower area of the inner lens, and a second inner lens attached to the first inner lens on an upper side of the first inner lens, wherein the light source is configured to face a lower side of the inner lens, wherein light output through one side surface of the inner lens after being input through the lower side of the inner lens forms a first lighting image, and wherein light output through the main plane of the inner lens, which faces the upper side, after being input through the lower side of the inner lens forms a second lighting image having a shape that is different from the first lighting image, wherein the first lighting image is formed by the light output through the one side surface of the second inner lens after being input through a lower side of the second inner lens.

2. The lamp of claim 1, wherein the first lighting image has a 2D image, the second lighting image has a 3D image.

3. The lamp of claim 1, wherein the second lighting image is formed by light output through an upper surface of the second inner lens after being input through the lower side of the second inner lens.

4. The lamp of claim 1, wherein the second inner lens is a lenticular lens.

5. The lamp of claim 1, wherein the first inner lens includes:

a body part defining a body of the first inner lens;

a downward protrusion provided at a front end of the body part and protruding downwards; and forward protrusion provided on a front surface of the downward protrusion and protruding to a front side of the lamp.

6. The lamp of claim 5, wherein the body part includes:

a condensing surface formed to be convex from a lower side of the body part to an outer side, and to which the light from the light source is input; and a diffusion surface formed at an upper portion of the body part, and configured to output the light input to the condensing surface to the second inner lens.

7. The lamp of claim 6, wherein the condensing surface includes a Fresnel lens shape configured to condense the light from the light source.

8. The lamp of claim 6, wherein the diffusion surface includes:

a fine optic configured to diffuse the light from the light source.

9. The lamp of claim 6, wherein the diffusion surface includes:

a fine optic configured to diffuse the light from the light source after the light converges.

10. The lamp of claim 5, wherein the forward protrusion includes:

a first forward protrusion extending from an end of the downward protrusion and protruding to the front side; and a second forward protrusion protruding from the downward protrusion to the front side, and provided at an upper portion of the first forward protrusion.

11. The lamp of claim 10, further comprising:

a board, on which the light source is provided; and a support member provided under the board, a partial area of which is attached to the second forward protrusion.

12. The lamp of claim 11, wherein the support member is attached to a front surface and an upper surface of the second forward protrusion.

13. The lamp of claim 11, wherein the first forward protrusion contacts the board on an upper side of the board.

14. The lamp of claim 1, wherein an upper surface of the inner lens and a lower surface of the second inner lens are bonded to each other.

15. The lamp of claim 1, further comprising:

a reflector provided at an upper portion of the second inner lens, wherein a rear end of the second inner lens is inserted into a space between a rear end of the reflector and a rear end of the first inner lens.

16. The lamp of claim 15, wherein the reflector is formed in a planar shape, inclined toward a front side, and reflects the light output through an upper surface of the second inner lens.

17. The lamp of claim 15, wherein the reflector is formed in a curved shape, configured such that a convex surface thereof is inclined toward a front side, and reflects light output through an upper surface of the second inner lens to the front side.

18. The lamp of claim 15, wherein the first inner lens includes:

an upward protrusion provided at the rear end of the first inner lens, protruding upwards toward the reflector, and the second inner lens is attached to a front surface of the upward protrusion.

19. A vehicle including a lamp wherein the lamp includes: a light source configured to irradiate light; and an inner lens having one surface that faces the light source, wherein the inner lens is disposed in a horizontal direction such that a main plane thereof faces an upper side of the lamp and a lower side of the lamp, and wherein the inner lens includes at least: a first inner lens provided in a lower area of the inner lens, and a second inner lens attached to the first inner lens on an upper side of the first inner lens, wherein the light source is configured to face a lower side of the inner lens, wherein light output through one side surface of the inner lens after being input through the lower side of the inner lens forms a first lighting image, and wherein light output through the main plane of the inner lens, which faces an upper side, after being input through the lower side of the inner lens forms a second lighting image having a shape that is different from the first lighting image, wherein the first lighting image is formed by the light output through the one side surface of the second inner lens after being input through a lower side of the second inner lens.

* * * * *